US008815349B2

(12) United States Patent
Taira et al.

(10) Patent No.: US 8,815,349 B2
(45) Date of Patent: Aug. 26, 2014

(54) HOT DIP GALVANIZED STEEL SHEET AND METHOD FOR MANUFACTURING SAME

(75) Inventors: Shoichiro Taira, Fukuyama (JP); Yoshiharu Sugimoto, Kurashiki (JP); Yoichi Miyakawa, Fukuyama (JP); Akira Gamou, Fukuyama (JP); Masayasu Nagoshi, Fukuyama (JP); Takashi Kawano, Kawasaki (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 13/208,939

(22) Filed: Aug. 12, 2011

(65) Prior Publication Data

US 2012/0031531 A1 Feb. 9, 2012

Related U.S. Application Data

(62) Division of application No. 10/569,617, filed as application No. PCT/JP2004/012704 on Aug. 26, 2004, now Pat. No. 8,025,980.

(30) Foreign Application Priority Data

| | | |
|---|---|---|
| Aug. 29, 2003 | (JP) | 2003-307072 |
| Aug. 29, 2003 | (JP) | 2003-307073 |
| Sep. 17, 2003 | (JP) | 2003-324770 |
| Sep. 17, 2003 | (JP) | 2003-324771 |
| Jan. 16, 2004 | (JP) | 2004-008967 |

(51) Int. Cl.

| | |
|---|---|
| ***C23C 2/26*** | (2006.01) |
| ***C23C 22/82*** | (2006.01) |
| ***C23C 22/50*** | (2006.01) |
| ***C23C 2/06*** | (2006.01) |
| ***C23C 2/28*** | (2006.01) |
| ***C23C 22/08*** | (2006.01) |
| ***C23C 22/53*** | (2006.01) |
| ***C23C 22/78*** | (2006.01) |

(52) U.S. Cl.

CPC . *C23C 2/26* (2013.01); *C23C 22/82* (2013.01); *C23C 22/50* (2013.01); *C23C 2/06* (2013.01); *C23C 2/28* (2013.01); *C23C 22/08* (2013.01); *C23C 22/53* (2013.01); *C23C 22/78* (2013.01)

USPC ..... 427/435; 427/331

(58) Field of Classification Search

USPC ..... 427/430.1, 435, 436

See application file for complete search history.

(56) References Cited

U.S. PATENT DOCUMENTS

| | | | | |
|---|---|---|---|---|
| 6,699,592 | B2 * | 3/2004 | Taira et al. | 428/659 |
| 7,338,718 | B2 * | 3/2008 | Taira et al. | 428/633 |

FOREIGN PATENT DOCUMENTS

| | | | |
|---|---|---|---|
| EP | 1288325 | | 3/2003 |
| EP | 1288325 | A1 * | 3/2003 |
| EP | 1616973 | | 1/2006 |
| JP | 53060332 | | 5/1978 |
| JP | 01319661 | | 12/1989 |
| JP | 02190483 | | 7/1990 |
| JP | 03191093 | | 8/1991 |
| JP | 04088196 | | 3/1992 |
| JP | 2001323358 | | 11/2001 |
| JP | 2002256448 | | 9/2002 |
| JP | 2003138362 | | 5/2003 |
| JP | 2003138364 | | 5/2003 |
| WO | WO 0181646 | A1 * | 11/2001 |
| WO | WO 2004094683 | A1 * | 11/2004 |

OTHER PUBLICATIONS

Computer Transation JP 2002-256448.*

Computer Translation JP 2003138362.*

Supplementary European Search Report for EP04772660 dated Jun. 12, 2009.

* cited by examiner

*Primary Examiner* — David Turocy

(74) *Attorney, Agent, or Firm* — RatnerPrestia

(57) ABSTRACT

The invention provides a hot dip galvanized steel sheet which has: a hot dip galvanizing layer having a flat part on a surface thereof; and a film formed on the flat part. The film is composed of a compound containing Zn, Fe, and O, having an average film thickness A in a range from 10 to 100 nm determined by an element analysis of the film, and has {[Fe]/([Zn]+[Fe])} in the film in a range from 0.002 to 0.25, where [Zn] and [Fe] designate the content (% by atom) of Zn and Fe in the film, respectively. Since the hot dip galvanized steel sheet of the invention has excellent press-formability, bondability, and phosphatability, it is suitable for automobiles and electrical appliances.

14 Claims, 3 Drawing Sheets

HOT DIP GALVANIZED STEEL SHEET AND METHOD FOR MANUFACTURING SAME

This application is a Divisional Application of Application No. 10/569,617, filed Feb. 24, 2006, now U.S. Pat. No. 8,025,980, which was a U.S. National Phase Application of PCT/JP2004/012704, filed Aug. 26, 2004 and which claims priority to Japanese Patent Application No. 2003-307072, filed Aug. 29, 2003, Japanese Patent Application No. 2003-307073, filed Aug. 29, 2003, Japanese Patent Application No. 2003-324770, filed Sep. 17, 2003, Japanese Patent Application No. 2003-324771, filed Sep. 17, 2003 and Japanese Patent Application No. 2004-008967, filed Jan. 16, 2004, each of these applications being incorporated herein in their entirety for all purposes.

TECHNICAL FIELD

The present invention relates to a hot dip galvanized steel sheet (including galvannealed steel sheet) which has excellent press-formability, bondability, and phosphatability, and which is used for thin steel sheet for automobile and the like, and also to a method for manufacturing thereof.

BACKGROUND ART

Hot dip galvanized steel sheets are widely used in automobiles, electrical appliances, and other apparatuses owing to their good corrosion resistance compared with ordinary cold-rolled steel sheets. The hot dip galvanized steel sheets in these uses are often press-formed. The hot dip galvanized steel sheets have, however, a drawback of inferiority in press-formability compared with the cold-rolled steel sheets because the galvanizing components in the hot dip galvanized steel sheet adhere with the press die thus making the sliding resistance between the steel sheet and the die large and instable compared with that for the cold-rolled steel sheets. That is, for a hot dip galvanized steel sheet, the steel sheet becomes difficult in sliding into the die during the press-forming stage at a portion such as bead part where the sliding resistance increases, which likely induces fracture of the steel sheet.

A common practice to improve the press-formability of zinc-based plated steel sheet is a method of coating a high viscosity lubricant oil. The method, however, has problems such as the generation of defects during the painting stage caused by insufficient degreasing, and the instable press-formability during the press-forming stage caused by absence of the lubricant oil. To solve these problems, minimization of the quantity of lubricant oil is an effective means. To do this, however, the improvement in the press-formability of zinc-based plated steel sheet is required.

The galvannealed steel sheet is a hot dip galvanized steel sheet which formed an Fe—Zn alloy layer thereon after heating thereof. The alloy layer is normally composed of Γ phase, $\delta_1$ phase, and ζ phase. When the Fe concentration decreases, the alloy layer tends to decrease in hardness and melting point in an order of Γ phase→$\delta_1$ phase→ζ phase. From the viewpoint of sliding performance, the Γ phase with high Fe concentration is effective because of the high hardness, the high melting point, and the hardly-inducing adhesion. Accordingly, the galvannealed steel sheet which emphasizes the press-formability is manufactured so as to have a high average Fe concentration in the alloy layer.

When, however, the average Fe concentration in the alloy layer increases, the Γ phase which is hard and brittle is likely formed at the interface between the plating and the steel sheet, thereby likely inducing a phenomenon of peeling of plating (what is called the "powdering") in the vicinity of the interface during the press-forming stage.

JP-A-1-319661, (the term "JP-A" referred to herein signifies the "Unexamined Japanese Patent Publication"), discloses a method of forming a hard iron-based alloy as the secondary layer on ordinary alloy layer using electroplating method or the like to attain both the sliding performance and the powdering resistance. The double plating layer, however, increases the manufacturing cost.

Further low cost methods are disclosed in JP-A-53-60332 and JP-A-2-190483. According to these disclosed technologies, the weldability and the press-formability are improved by forming an oxide film composed mainly of ZnO on the surface of a zinc-based plated steel sheet applying electrodeposition treatment, dipping treatment, coating oxidation treatment, or heat treatment.

JP-A-4-88196 discloses a technology to improve the press-formability and the phosphatability by forming an oxide film composed mainly of a P oxide on the surface of a zinc-based plated steel sheet by dipping the steel sheet in an aqueous solution of pH 2 to 6, containing 5 to 6 g/liter of sodium phosphate, by applying electrodeposition treatment in the aqueous solution, or by spraying the aqueous solution onto the steel sheet.

Furthermore, JP-A-3-191093 discloses a technology to improve the press-formability and the phosphatability by forming a Ni oxide film on the surface of a zinc-based plated steel sheet by applying electrodeposition treatment, dipping treatment, coating treatment, coating oxidation treatment, or heat treatment.

However, the inventors of the present invention applied the technologies disclosed in the respective JP-A-53-60332, JP-A-2-190483, JP-A-4-88196, and JP-A-3-191093 to hot dip galvanized steel sheets, and found that these technologies cannot improve stably the press-formability. Detail study for the cause of failing in attaining the stable improvement has revealed the following. A hot dip galvanized steel sheet contains Al oxide, and a galvannealed steel sheet contains an irregularly distributed Al oxide and has an increased roughness on the surface of plating layer, thus a desired film cannot be stably formed for both cases even by electrodeposition treatment, dipping treatment, coating oxidation treatment, heat treatment, and the like. Specifically for the galvannealed steel sheet, several micrometers or larger irregular profile on the surface thereof is created owing to the non-uniformity of alloying reaction and to the shape of Fe—Zn alloy phase, thereby increasing the sliding resistance at the surface of plateau to deteriorate the press-formability. Furthermore, the inventors of the present invention determined the friction factor of ZnO film formed on each of the hot dip galvanized steel sheet and the galvannealed steel sheet by a physical method, and found that sufficient press-formability cannot be attained. The findings lead to a conclusion that the conventional technologies of forming a ZnO film on the surface of plating layer cannot expect the sufficient improvement in the press-formability even when a uniform film is formed.

To this point, the inventors of the present invention disclosed a technology to improve the sliding performance in JP-A-2001-323358. According to the disclosure, a plateau is formed on a plating layer on a galvannealed steel sheet, and a film composed of an oxide or a hydroxide containing Zn, Fe, Al, and the like is formed on the plateau, and further a fine irregular profile is formed on the surface of plateau including the film.

Although the technology disclosed in JP-A-2001-323358 improves the press-formability more than the technologies disclosed in the above patent publications, there was occurred insufficient improvement in the press-formability in some cases.

In recent years, the bonding method of hot dip galvanized steel sheets increases the cases of applying adhesives to bonding the steel sheets together. To do this, however, the hot dip galvanized steel sheets have to have strong bonding strength, or have excellent bondability.

The above-described conventional technologies, however, decrease the bondability and the phosphatability, in some cases, by forming a film on the hot dip galvanized steel sheet.

DISCLOSURE OF THE INVENTION

An object of the present invention is to provide a hot dip galvanized steel sheet having excellent press-formability, bondability, and phosphatability, and to provide a method for manufacturing thereof.

The above object is attained by a hot dip galvanized steel sheet which has: a hot dip galvanizing layer having a plateau on a surface thereof; and a film formed on the plateau, which film is composed of a compound containing Zn, Fe, and O, has an average film thickness A in a range from 10 to 100 nm determined by an element analysis of the film, and has {[Fe]/([Zn]+[Fe])} in the film in a range from 0.002 to 0.25, where [Zn] and [Fe] designate the content (% by atom) of Zn and Fe in the film, respectively.

The hot dip galvanized steel sheet according to the present invention can be manufactured by a manufacturing method having the steps of: hot-dip-galvanizing a steel sheet; temper-rolling the hot dip galvanized steel sheet to form a plateau on a surface of the galvanized layer; bringing the temper-rolled hot dip galvanized steel sheet into contact with an acidic solution containing Fe ion and having a pH buffering effect to form a film being composed of a compound containing Zn, Fe, and O on a surface of the plating layer; and allowing to standing the hot dip galvanized steel sheet for 1 to 30 seconds after contacting with the acidic solution, followed by washing thereof with water.

EMBODIMENTS OF THE INVENTION

Figure 1:
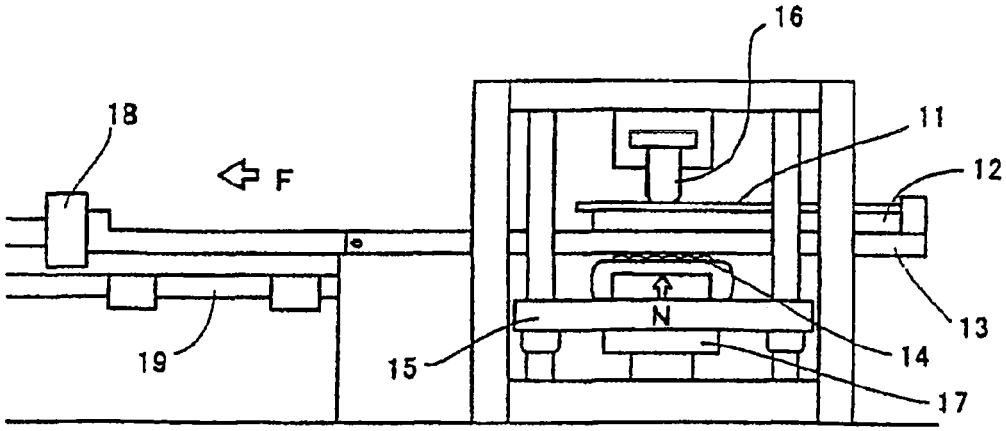
FIG. 1 is a schematic drawing of flat sliding test apparatus.

An effective means to improve the press-formability of hot dip galvanized steel sheet is to decrease the sliding resistance of the surface of plating layer contacting directly with the die during the press-forming stage.

To do this, a plateau is formed on the surface of plating layer, and a film of an O-containing compound such as an oxide, which can decrease the sliding resistance, is formed on the plateau, thereby limiting most part of the surface contacting with the die during the press-forming stage to the plateau, and effectively reducing the sliding resistance.

A presumable reason of decreasing the sliding resistance by forming a film of O-containing compound, or of attaining good lubrication, is that the O-containing compound such as an oxide is generally hard and has high melting point, thus the adhesion of the plating layer with the die can be suppressed.

For the case of galvannealed steel sheet, when a plateau is formed on the surface of plating layer by a mechanical means such as temper-rolling, the oxide containing Al, existing on the surface of plating layer, can be destroyed locally, thereby efficiently and uniformly providing the film of O-containing compound.

The percentage of the plateau on the surface of plating layer is preferably in a range from 30 to 70% by area.

For attaining a film having further high lubrication and having excellent bondability and phosphatability, it is effective to add Zn and Fe to the compound. Since the ion radius of Zn (II) differs from that of Fe, the growth of Zn oxide and Fe oxide interferes with each other, thereby refining the compound. Actually, according to a finding of the inventors of the present invention, the film of an oxide containing Zn and Fe likely becomes fine lamellar-like oxides compared with the film of oxide only of Zn, which likely forms coarse plate-like oxides. Although the reason of attaining that high lubrication by that type of film is not fully analyzed, a presumable reason is that Fe varies the electron state of the oxide of Zn to increase the adsorption of the lubricant oil on the film, or that the O-containing compound is refined to an appropriate compound size to increase the adsorption area of the lubricant oil on the film. Since that fine compounds are formed, the surface of plating layer has strong adhesion, thus not decreasing the bondability. The non-decrease in the bondability is attained presumably by a large number of contact points between the compounds and the surface of plating layer, and by not-concentrated external force to a specific compound. The refinement of the compound is expected to improve the bonding strength with the adhesives on bonding the steel sheets using adhesives and the like, thereby contributing to the improvement of the bondability of the hot dip galvanized steel sheets. Since the refined compounds readily dissolve during the phosphatization treatment even if they remain until immediately before the phosphatization treatment, they do not adversely affect the formation of phosphatized film. Therefore, good phosphatability is attained.

As described above, with the film composed of a compound containing Zn, Fe, and O, high lubrication and excellent bondability and phosphatability are attained. To do this, it is necessary to regulate the ratio of the quantity of Fe to the sum of the quantity of Zn, [Zn] (% by atom), and the quantity of Fe, [Fe] (% by atom), or {[Fe]/([Zn]+[Fe]), in the film to a range from 0.002 to 0.25. If the ratio of the quantity of Fe is smaller than 0.002, a plate-like oxide composed mainly of Zn, which has weak bondability between the surface of plating layer and the O-containing compound, is formed, thereby decreasing the adhesion of film and further decreasing the bondability. In addition, no effect of Fe addition to oxides is obtained, and it is not insufficient to improve the lubrication. On the other hand, if the ratio becomes larger than 0.25, the efficiency to form the O-containing compound decreases, thus, in an ordinary chemical method for film-forming using a solution fails to form stably a film having large film thickness necessary to decrease the sliding resistance. Furthermore, that excessively large quantity of Fe gives excessively refined film, which results in insufficient effect to improve the lubrication. Consequently, the ratio {[Fe]/([Zn]+[Fe]} has to be specified to a range from 0.002 to 0.25. If the ratio is within a range from 0.002 to 0.15, further high lubrication and excellent adhesion are attained.

The {[Fe]/([Zn]+[Fe]}in the film was determined by a transmission electron microscope (TEM) and an energy-dispersive X-ray spectrometer (EDS). That is, a cross section sample of the surface layer was cut to prepare from the plateau of the surface of plating layer using the focused ion beam processing (FIB) method, and electron beams were radiated onto the film on the sample, then the element analysis was applied on 5 to 10 points along the film thickness using EDS, followed by determining the atom concentration using the approximation as film. Since the percentages of Fe in the film may be non-uniform in the depth direction in some cases, the [Fe] is an average value of the Fe quantities determined at the respective analytical points. The judgment inside the film was given by defining the point where the X-ray intensity of Zn becomes half the intensity on the surface of plating layer as the interface at the steel sheet side, and by defining the point where the X-ray intensity of Zn in the film becomes half as the surface. Alternatively, scanning Auger microscope (SAM) can be used to conduct the element analysis at the surface of the plateau of the plating layer to determine the {[Fe]/([Zn]+[Fe]} value. Nevertheless, if the percentages of Fe in the film are non-uniform in the depth direction, the TEM method gives more correct determination.

The average film thickness A which is determined by the element analysis of the film composed of a compound containing Zn, Fe, and O has to be 10 nm or larger to sufficiently decrease the sliding resistance. On the other hand, if the average film thickness A becomes larger than 100 nm, the film is fractured during the press-forming stage to increase the sliding resistance, to decrease the film adhesion, and to deteriorate the weldability of hot dip galvanized steel sheet. Therefore, the average film thickness A determined by the film element analysis of the film is required to enter the range from 10 to 100 nm.

The average film thickness A determined from the element analysis of the film was derived by SAM combined with $Ar^+$ sputtering. That is, the secondary electron image observation function in SAM identified, (readily identifiable), the plateau on the surface of plating layer, and the sputtering and the observation were repeated down to a depth where the O concentration becomes almost unchanged applying the $Ar^+$ sputtering at 3 kV of acceleration voltage over a region of about 3 μm×3 μm on the surface of plateau down to a specified depth, then the composition at the depth was determined from the detected element peak intensity applying a relative sensitivity factor correction. After the O content in the film became the maximum value at a certain depth, (the depth may be the uppermost layer in some cases), the O content decreased to give a constant value. The film thickness A was determined by converting a sputtering time, when the sum of the maximum value and the reached constant value becomes half at a depth deeper than the depth that gives the maximum value of O content, into the depth, based on the sputter rate of, for example, a $SiO_2$ film having a known film thickness. The observation was given to at least three flat parts per a single sample, and the average of the three observed values was derived.

If the average film thickness B determined by observation of film thickness cross section is in a range from 20 to 1000 nm, and if the film thickness ratio B/A is 1.5 or larger, further high lubrication is attained, and further low sliding resistance is attained. A film having large ratio of the average film thickness B to the average film thickness A means a film having a large void fraction therein. Larger B/A value provides higher lubrication because the positions for adsorbing the lubricant oil increase and because the lubricant oil easily enters the void, thus larger B/A provides higher lubrication.

If the average, film thickness B is smaller than 20 nm, or if the ratio B/A is smaller than 1.5, the void fraction in the film becomes small, which fails to attain high lubricant. If the average film thickness B exceeds 1000 nm, the weldability deteriorates, and the manufacturing cost increases.

Formation of a film having the average film thickness B in a range from 20 to 1000 nm and having the film thickness ratio B/A of 1.5 or larger is attained by decreasing the value of {[Fe]/([Zn]+[Fe]} within the range of the present invention, or by decreasing the quantity of Fe in the film.

The average film thickness B determined by observation of film thickness cross section was derived from the observation of bright field image of TEM. The TEM observation sample was prepared by forming a carbon layer on the surface of plating layer using a carbon coater to protect the surface, and then by cutting the cross section at the plateau of the surface of plating using FIB method, thus obtaining the cross section sample of the surface of plating layer containing the film. The bright field image on the cross section of plating layer was observed and photographed under a defocus condition slightly offset from the just-focus point (focused state). Then, straight lines were drawn between the individual peak points on the film over about 10 μm length parallel to the film, and the lengths of these lines were averaged to obtain the average film thickness B.

Applicable compound containing Zn, Fe, O, forming the film includes an oxide, a hydroxide, and a mixture thereof.

The present invention is also applicable to a galvannealed. steel sheet on which the hot dip galvanizing layer is processed by alloying treatment.

The hot dip galvanized steel sheet according to the present invention can be manufactured, as described before, by a method having the steps of: hot-dip-galvanizing a steel sheet; temper-rolling the hot dip galvanized steel sheet to forma plateau on a surface of the galvanized plating layer; bringing the temper-rolled hot dip galvanized steel sheet into contact with an acidic solution containing Fe ion and having a pH buffering effect to form a film composed of a compound containing Zn, Fe, and O on a surface of the plating layer; and allowing the hot dip galvanized steel sheet to standing for 1 to 30 seconds after contacting with the acidic solution, followed by washing thereof with water.

When a hot dip galvanized steel sheet is brought into contact with an acidic solution, zinc in the plating layer dissolves. The dissolution of zinc is considered to accompany the generation of hydrogen so that the hydrogen ion concentration in the acidic solution decreases along with the progress of zinc dissolution, and pH of the acidic solution increases, thereby forming a film of O-containing compound composed mainly of Zn on the surface of zinc plating layer. When the acidic solution has a pH buffering effect, the pH increase in the acidic solution becomes mild even if zinc dissolves and even if hydrogen generation reaction begins, thus the zinc dissolution positively proceeds to form a film of O-containing compound, sufficient to improve the sliding performance. When Fe ion exists in the acidic solution, the Fe ion reduction reaction begins to precipitate trace amount of Fe on the surface of plating layer, which suppresses the excess growth of the film of O-containing compound composed mainly of Zn, thereby forming a film of very fine compound.

The hot dip galvanized steel sheet after contacting with the acidic solution is washed with water. If the time for allowing to standing prior to the washing with water is less than 1 second, the acidic solution is removed before forming the film of O-containing compound composed mainly of Zn. If the time therefor is more than 30 seconds, the film thickness saturates. Therefore, the hot dip galvanized steel sheet after contacting with the acidic solution has to be washed with water after allowing to standing for a period from 1 to 30 seconds.

When the hot dip galvanized steel sheet is brought into contact with the acidic solution, the acidic solution is preferably retained on the surface thereof as a thin film. Excess acidic solution retained on the surface of the steel sheet does not increase the pH of the solution even when the zinc dissolution occurs, and the formation of an O-containing compound composed mainly of Zn may take a long time, and further the plating layer may be significantly damaged to lose the rust-preventive performance inherent in the plating layer. Accordingly, the quantity of acidic solution retained on the surface of hot dip galvanized steel sheet is preferably 3 $g/m^2$ or smaller. The adjustment of the quantity of acidic solution can be done by squeeze-rolling, air-wiping, and the like.

The Fe ion being added to the acidic solution has two kinds: $Fe^{2+}$ and $Fe^{3+}$. Both of these Fe ions are effective to form a film of a fine compound containing Zn, Fe, and O. However, presence of $Fe^{3+}$ generates large amount of sludge in the acidic solution to likely cause bruising on the surface of the steel sheet. Accordingly, smaller $Fe^{3+}$ concentration is better. Since, however, $Fe^{2+}$ is actually oxidized with time to increase $Fe^{3+}$, an acidic solution free from $Fe^{3+}$ cannot be attained. Therefore, the control of $Fe^{3+}$ concentration in the acidic solution is important, and the $Fe^{3+}$ concentration is preferably limited to 2 g/liter or smaller to prevent the occurrence of bruising. The control of $Fe^{3+}$ concentration can be done by renewing the acidic solution when the $Fe^{3+}$ concentration exceeds 2 g/liter, or by dissolving Fe in the acidic solution to utilize the $Fe^{3+}$ reduction reaction.

To stably form the film of a compound containing Zn, Fe, and O, it is preferable to use an acidic solution having pH buffering effect within a region of pH from 2 to 5. An index for the evaluation of the pH buffering effect is the degree of pH increase, which is defined by the quantity of an aqueous solution of 1 mole/liter sodium hydroxide solution (ml) necessary to increase the pH of 1 liter of the acidic solution from 2 to 5. Specifying the degree of pH increase in a range from 3 to 20 is preferred to stably form the film of a compound containing Zn, Fe, and O at thicknesses of 10 nm or more in a plateau on the surface of plating layer. The specification of the pH increase region in a range from 2 to 5 is adopted because the pH larger than 5 triggers the generation of Zn oxide and becomes difficult to form the film of a compound containing Zn, Fe, and O having the thicknesses of 10 nm or larger even if the steel sheet is allowed to standing for a long time after contacting with the acidic solution, and because the pH smaller than 2 fails to substantially contribute to the easiness of forming the film of a compound containing Zn, Fe, and O. If the pH increase degree is smaller than 3, the pH increase proceeds rapidly to fail in sufficient zinc dissolution, which results in insufficient formation of the film of a compound containing Zn, Fe, and O. If the pH increase degree exceeds 20, the zinc dissolution is enhanced to take a long time for forming the film of a compound containing Zn, Fe, O, and also the plating layer may be seriously damaged to lose the rust-preventive performance inherent in the plating layer. Regarding the pH increase degree of the acidic solution having pH larger than 2, the evaluation is given by decreasing the pH of the acidic solution to 2 by adding an inorganic acid having very little pH buffering effect, such as sulfuric acid, to the acidic solution within a pH range from 2 to 5.

Applicable acidic solution having the pH buffering effect includes the one having pH from 1 to 5 and containing 5 to 50 g/liter of pH buffer of at least one of: acetic acid salt such as sodium acetate ($CH_3COONa$); phthalic acid salt such as potassium hydrogen phthalate ($(KOOC)_2C_6H_4$); citric acid salt such as sodium citrate ($Na_3C_6H_5O_7$) and potassium dihydrogen citrate ($KH_2C_6H_5O_7$); succinic acid salt such as sodium succinate ($Na_2C_4H_4O_4$); lactic acid salt such as sodium lactate ($NaCH_3CHOHCO_2$); tartaric acid salt such as sodium tartarate ($Na_2C_4H_4O_6$); boric acid salt; and phosphoric acid salt. If the concentration of the pH buffer is smaller than 5 g/liter, the pH increase begins relatively early along with the dissolution of zinc, which fails to form the film of a compound containing Zn, Fe, O, Sufficient to improve the sliding performance. If the concentration of the pH buffer exceeds 50 g/liter, the zinc dissolution is enhanced to take a long time for forming the film of a compound containing Zn, Fe, and O, and the plating layer may be seriously damaged to lose the rust-preventive performance inherent in the plating layer. If the pH of the acidic solution is smaller than 1, formation of the film of a compound containing Zn, Fe, and O becomes difficult, though the zinc dissolution is enhanced. If the pH of the acidic solution exceeds 5, the dissolution rate of zinc decreases. Consequently, the pH of acidic solution is preferably in a range from 1 to 5. If the pH of acidic solution is larger than 5, the pH can be adjusted by an inorganic acid having no pH buffering effect, such as sulfuric acid, or by an acidic solution of the applying salt such as the salt of acetic acid, phthalic acid, and citric acid.

To add Fe ion to the acidic solution, it is preferred to add at least one of sulfuric acid salt, nitric acid salt, and chloride of Fe, and further to adjust the Fe ion concentration to a range from 0.1 to 100 g/liter. If the Fe ion concentration is smaller than 0.1 g/liter, the film of a compound containing Zn, Fe, and O is formed solely by the above salts having the pH buffering effect, and the film thickness control and the refinement of compound may become difficult. If the Fe ion concentration exceeds 100 g/liter, the growth of the film of a compound containing Zn, Fe, and O is significantly suppressed, and the film necessary to improve the sliding performance may not be formed. Although the addition of Fe ion is effective in the film thickness control and the refinement of compound, the Fe ion in the acidic solution enhances the dissolution of the plating layer to bring the plating layer weak, thus more likely inducing the peeling of plating, or what is called the "powdering", during the press-forming stage. From this viewpoint, the Fe ion is preferably 10 g/liter or smaller. When the application to a position being subjected to severe bending/unbending deformation is expected; the Fe ion concentration is more preferably 5 g/liter or smaller. The term "Fe ion concentration" referred to herein signifies the total concentration of $Fe^{2+}$ and $Fe^{3+}$.

Before the hot dip galvanized steel sheet is brought into contact with the acidic solution, it is preferable to bring the steel sheet into contact with an alkaline solution to activate the surface thereof. The contacting with alkaline solution is adopted by the reason described below. For a galvannealed steel sheet, although the oxide containing Al, formed on the surface of plating layer after plating, is fractured and removed by the roll during the temper-rolling stage, a part thereof still remains on the surface of plating layer, which makes the reactivity with the acidic solution non-uniform, thereby may failing in forming a homogeneous film of a compound containing Zn, Fe, and O. For the case of non-alloyed hot dip galvanized steel sheet, the surface of plateau has a portion which does not contact with the roll face of the temper-rolling and which retains the oxide containing Al, thus the surface activation is specifically preferred to be performed by applying alkali treatment or the like to remove a part or all of the oxide.

There is no specific limitation of the method for contacting with alkaline solution, and dipping method, spray method, and the like may be applied. If the pH of alkaline solution is low, the reaction becomes slow to take a long time for the treatment. Accordingly the pH of alkaline solution is preferably 10 or larger. Applicable alkaline solution includes sodium hydroxide.

If the acidic solution is retained on the surface of hot dip galvanized steel sheet after water-washing and drying, the steel sheet coil likely generates rust during a long time of storage To prevent the rust generation, it is preferred to bring the hot dip galvanized steel sheet after contacting with the acidic solution dip in an alkaline solution or to spray an alkaline solution to neutralize the acidic solution remained on the surface of the steel sheet. In this case, the pH of the alkaline solution is preferably 12 or smaller to prevent the dissolution of the film of a compound containing Zn, Fe, O, formed on the surface of plating layer. Applicable alkaline solution includes sodium hydroxide and sodium phosphate.

Similar effect is attained by heating the steel sheet after hot-dip-galvanizing to process the plating layer by alloying treatment.

As described above, since the present invention uses an acidic solution containing Fe ion and having pH buffering effect, a film of a compound containing Zn, Fe, O, providing excellent sliding performance, bondability, and phosphatability can be stably formed. Even when the acidic solution contains other metallic ions and inorganic compounds as impurities or as intentional additives, the effect of the present invention is not deteriorated. In particular, when a hot dip galvanized steel sheet contacts with the acidic solution, although the Zn ion is dissolved to increase the Zn concentration in the acidic solution, the increase in the Zn ion concentration does not affect the effect of the present invention.

The zinc plating bath for manufacturing the hot dip galvanized steel sheet according to the present invention is required to contain Al. Even when elements other than Al, such as Fe, Pb, Sb, Si, Sn, Mn, Ni, Ti, Li, and Cu exist in the zinc plating bath, the effect of the present invention is not deteriorated.

Contacting the hot dip galvanized steel sheet with the acidic solution can be done by dipping the hot dip galvanized steel sheet in the acidic solution, by spraying the acidic solution thereto, by coating the acidic solution thereon using a roll, and the like.

Even when the film composed of a compound containing Zn, Fe, and O contains elements such as F, Mg, Al, Si, P, S, Cl, K, Ca, and Ba, existing in the acidic solution, or contains adsorbed water, the effect of the present invention is not deteriorated. The film is not necessarily formed continuously, and the film covering not the whole area of plateau is also effective. Nevertheless, to decrease the friction resistance, the film preferably covers 60% or more of the plateau.

Example 1

Galvannealed layer was formed on each of cold-rolled steel sheets having 0.8 mm of thickness using an ordinary method, which plated steel sheets were then processed by temper-rolling. After that, a film was formed on the surface of zinc plating layer under the respective treatment conditions given in Table 1 to prepare the sample Nos. 1 to 22.

With the treatment X in Table 1, a ZnO coating was formed by the reactive sputtering method.

With the treatments Y, Z, and A to E, a liquid film was formed on the surface of each steel sheet by spraying and roll-squeezing an acidic solution onto the surface of the steel sheet. The acidic solution at temperatures from 25° C. to 40° C. contained a pH buffer composed of sodium acetate and sodium citrate at the respective quantities given in Table 1, further contained iron (II) sulfate by 2 g/liter or smaller $Fe^{2+}$ concentration, and had the respective $Fe^{2+}$ concentrations given in Table 1. The formed liquid film was allowed to standing for a period given in Table 1, and then was immediately washed by spraying water at 50° C., followed by drying using a drier to form the film containing Zn, Fe, and O. The quantity of liquid film was adjusted by varying the pressure of squeeze-rolls. The pH of acidic solution was adjusted by adding sulfuric acid.

With thus prepared samples, average film thickness A, average film thickness B, and {[Fe]/([Zn]+[Fe])} in the film were determined using the respective above-described methods. Using the method described below, the coefficient of friction as an index of pres-formability was determined, and the bondability, the phosphatability, and the powdering resistance of the plating layer having the film were investigated.

(1) Determination of Coefficient of Friction

FIG. 1 is a schematic drawing of the flat sliding test apparatus used in the examples.

A sample 11 for determining the coefficient of friction is fixed on a sample table 12 which is fixed on the upper face of a horizontally movable slide table 13. At the lower face of the slide table 13, there is located a vertically movable slide table support 15 equipped with a roller 14 contacting with the slide table 13. A first load cell 17 is attached to the slide table support 15. The first load cell determines the pressing load N applied from a bead 16 to the sample 11 by pushing-up the slide table support 15. A second load cell 18 is attached to an end of the slide table 13. The second load cell 18 determines the sliding resistance F by moving the slide table 13 in the horizontal direction in a state of pressing the bead 16 against the sample 11. The tests were, conducted by coating a lubricant oil on the surface of the sample 11. The applied lubricant oil was PRETON R352L, a washing oil for press-work manufactured by Sugimura Chemical Industrial Co., Ltd.

Figure 2:
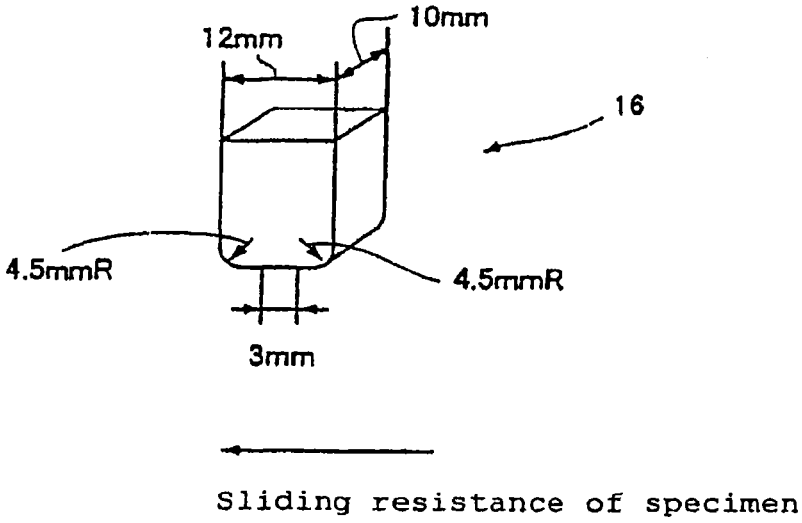
FIG. 2 shows an example of the shape of bead for determining the coefficient of fricrion.
Figure 3:
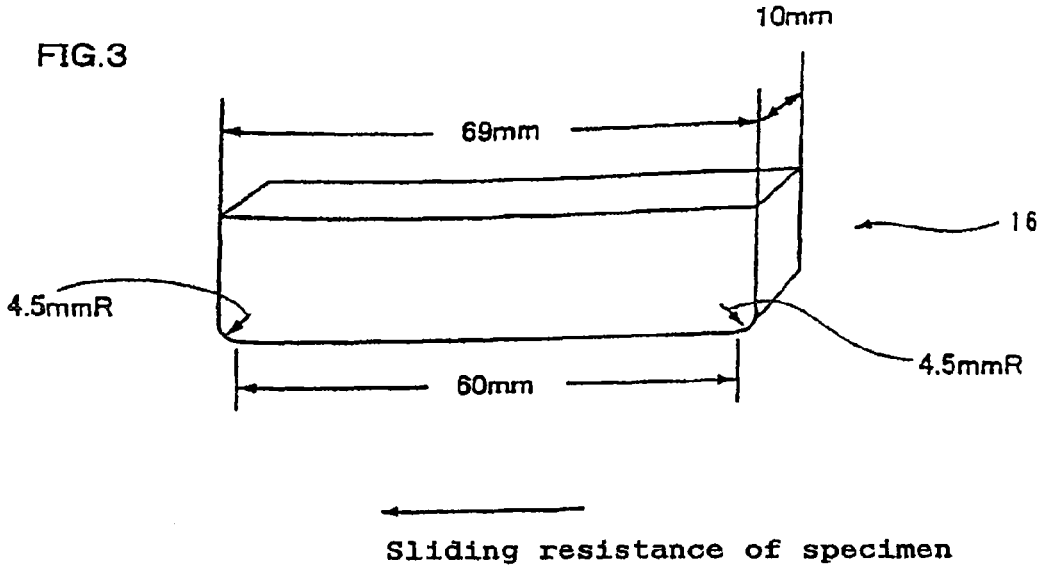
FIG. 3 shows another example of the shape of bead for determining the coefficient of fricrion.

FIG. 2 and FIG. 3 show the shapes of applied beads.

The bead 16 shown in FIG. 2 has the dimensions of 10 mm in width, 12 mm in the length in the sliding direction, 3 mm in the length in the sliding direction to which the sample is pressed, and 4.5 mm in the radius at each end in the sliding direction.

The bead 16 shown in FIG. 3 has the dimensions of 10 mm in width, 69 mm in the length in the sliding direction, 60 mm in the length in the sliding direction to which the sample is pressed, and 4.5 mm in the radius at each end in the sliding direction.

The sample slides under a condition that the flat part of the lower face of the bead 16 is pressed against the surface of the sample.

The flat sliding tests were conducted under the two conditions given below, and the coefficient of friction $\mu=F/N$ between the sample and the bead was calculated.

Condition 1: The bead shown in FIG. 2; 400 kgf of the pressing load N; and 100 cm/min of the sample sliding speed (the horizontal moving speed of the slide table 13).

Condition 2: The bead shown in FIG. 3; 400 kgf of the pressing load N; and 20 cm/min of the sample sliding speed.

(2) Bondability Test

Figure 4:
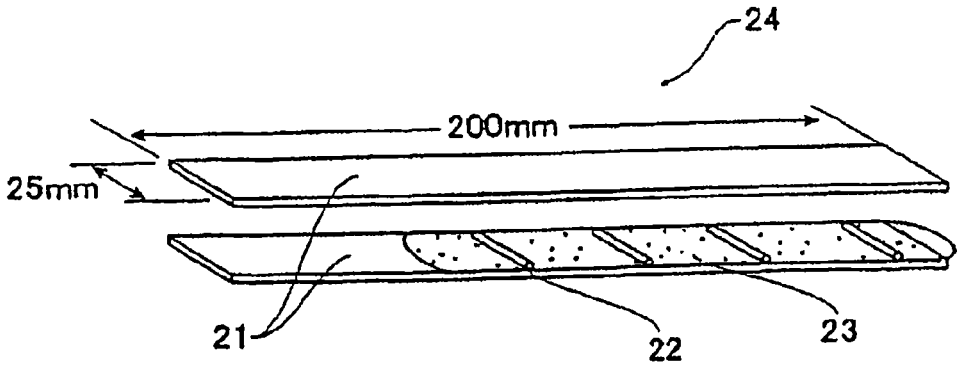
FIG. 4 illustrates a test piece for determining bondability.
Figure 5:
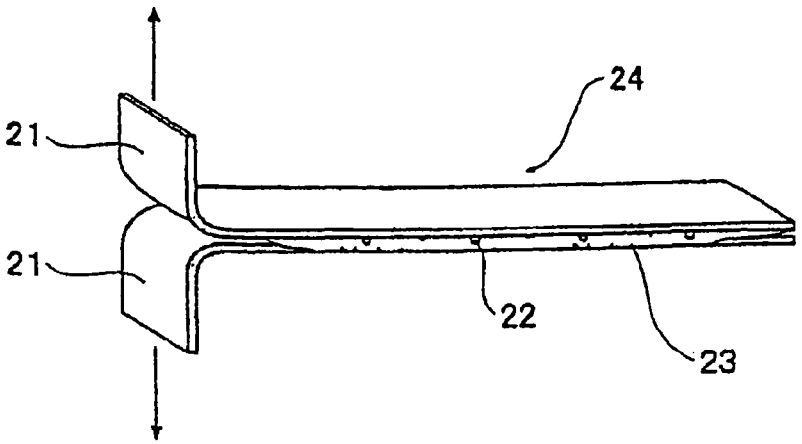
FIG. 5 illustrates the bondability test.

As illustrated in FIG. 4, two sheets of test pieces 21, each having 25 mm in width and 200 mm in length, were cut from each sample. An adhesive 23 was injected between the test pieces 21 via a spacer 22 having 0.12 mm in thickness, thus preparing an bondability test piece 24 which had a non-bonding portion at an end thereof. After baking the bondability test piece 24 at 150° C. for 10 minutes, the non-bonding portion was folded vertically to the bondability test piece as shown in FIG. 5. The folded portions were drawn by a tensile tester at a testing speed of 200 mm/min to conduct the peeling test. The applied adhesive 23 was an adhesive for hemming of vinyl chloride resin group.

The peeling occurs at the weakest position in terms of strength. If the adhesion between the test piece and the adhesive is sufficient, the peeling occurs by cohesive failure inside the adhesive. If the adhesion therebetween is insufficient, the peeling occurs at the interface between the test piece and the adhesive. The bondability was evaluated by the peeling mode, giving "○" rank to the peeling caused by the cohesive failure inside the adhesive as "superior bondability", and giving "X" rank to the peeling occurred at interface between the test piece and the adhesive as "inferior bondability". For the case of galvannealed steel sheet, particularly the case of forming Γ phase at the interface between the plating layer and the steel sheet gave weak strength at the interface between the plating layer and the steel sheet, thereby generating peeling at the interface in some cases. However, also that case was judged as "good bondability" between the sample piece and the adhesive, and gave the evaluation of "○" rank.

(3) Phosphatability Test

Each sample was treated under an ordinary condition using a dip-type zinc phosphate treatment solution for automobile surface treatment for coating, (PBL3080, manufactured by Nihon Parkerizing Co., Ltd.), and then a zinc phosphate film was formed thereon. The crystal state of the zinc phosphate film was observed by scanning electron microscope (SEM). The film formed in uniform state was evaluated as "○", and the film formed in non-uniform state was evaluated as "X".

(4) Powdering Resistance Test

Figure 6:
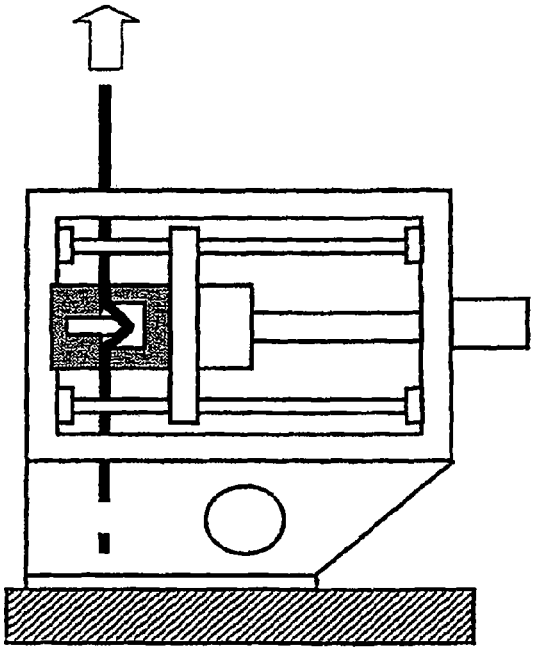
FIG. 6 is a schematic drawing of draw-bead tester.

FIG. 6 is a schematic drawing of the draw-bead tester used in the examples.

First, the plating layer on a face of a square test piece cut from the sample face not contacting with the bead was peeled using hydrochloric acid, and the weight $W_1$ g of the test piece was determined. Then, the test piece was attached to the tester given in FIG. 6. After pressing the triangle bead having 0.5 mm in tip radius against the test piece at 500 kgf load into 4 mm of penetration depth, the test piece was drawn out at a constant speed of 200 mm/min. For the drawn-out test piece, the contact face with the bead was forcefully peeled using an adhesive tape, then the weight $W_2$ g was determined. By dividing the ($W_1$-$W_2$) by the drawn-out area, the quantity of peeling per unit area was derived, and the powdering resistance was evaluated by the peeled quantities.

The result is given in Table 2.

For the Examples according to the present invention, where the film thickness A was 10 nm or larger and where the quantity ratio of Fe in the film, {[Fe]/([Zn]+[Fe])}, was in a range from 0.002 to 0.25, the friction factor was lower than that for the cases of Comparative. Examples 1 and 2, where no treatment was applied and no film was formed. The fact shows that Examples of the present invention have high lubrication.

When Example 10 of the present invention was compared with Comparative Example 5 having 0 of {[Fe]/([Zn]+[Fe])}, although having similar film thickness A with each other, Example 10. of the present invention gave lower coefficient of friction, which shows that, even with a same degree of film thickness, inclusion of Fe provides high lubrication.

Examples 17 and 19 of the present invention having 10 nm or larger film thickness A and having 1.5 or larger film thickness ratio B/A gave lower coefficient of friction than that of Comparative Example 6 having smaller than 1.5 of B/A, though having similar film thickness A. The fact shows that, even with a same degree of film thickness, large B/A provides high lubrication. In particular, larger B/A provides lower coefficient of friction stably. It is also understood that the increase in the film thickness ratio B/A is attained by the reduction in the percentage of Fe in the film.

Since the bondability, the phosphatability, and the powdering resistance of Examples of the present invention were similar with those of Comparative Examples 1 and 2 using ordinary galvannealed. steel sheets, the results are not given in Table 2. There was identified, however, a tendency of somewhat decreasing the adhesion between the film and the surface of plating layer when the percentage of Fe decreases. That is, with the ratio of Fe at 0.002 or larger, all the bondability tests gave cohesive failure inside the adhesive, thus no practical problem arises. However, in Comparative Example 11 with the ratio of Fe smaller than 0.002, the bondability test gave mixed occurrence of interfacial peeling, though the coefficient of friction was relatively decreased, thus failing to attain good bondability. When considering that Comparative Examples 6 to 8 gave insufficient formation of zinc phosphate crystals during phosphatization, it is shown that Examples 17 to 22 of the present invention having a similar film thickness A with each other give excellent phosphatability owing to the refining the film or to the increase in void fraction in the film.

Since the treatment solution applied was an acidic solution containing iron (II) sulfate, sulfur was detected by several percentages by weight in some cases. The presence of sulfur by that amount, however, did not affect the effect of the present invention.

TABLE 1

| Treatment | pH buffer (g/liter) | $Fe^{2+}$ concentration (g/liter) | Time for allowing to standing (sec) |
|---|---|---|---|
| X | — | — | — |
| Y | 0 | 60 | 7.5 |
| Z | 40 | 20 | 7.5 |
| A | 35 | 7 | 0.5-15 |
| B | 16 | 0.3 | 2.8-7.5 |
| C | 35 | 0.6 | 5 |
| D | 30 | 1 | 9-30 |
| E | 35 | 0 | 5 |

TABLE 2

| Sample No. | Treatment | {[Fe]/([Zn] + [Fe])} | Film thickness A (nm) | Film thickness B (nm) | Film thickness ratio B/A | Friction factor μ Condition 1 | Friction factor μ Condition 2 | Remark |
|---|---|---|---|---|---|---|---|---|
| 1 | — | — | — | — | — | 0.179 | 0.250 | Comparative example |
| 2 | — | — | 6 | — | — | 0.181 | 0.251 | Comparative example |
| 3 | X | 0 | 5 | 6 | 1.2 | 0.178 | — | Comparative example |
| 4 | X | 0 | 10 | 11 | 1.1 | 0.172 | — | Comparative example |

TABLE 2-continued

| Sample No. | Treatment | {[Fe]/([Zn] + [Fe])} | Film thickness A (nm) | Film thickness B (nm) | Film thickness ratio B/A | Friction factor μ Condition 1 | Friction factor μ Condition 2 | Remark |
|---|---|---|---|---|---|---|---|---|
| 5 | X | 0 | 23 | 28 | 1.2 | 0.163 | — | Comparative example |
| 6 | X | 0 | 35 | 42 | 1.2 | 0.153 | — | Comparative example |
| 7 | X | 0 | 49 | 64 | 1.3 | 0.141 | — | Comparative example |
| 8 | X | 0 | 99 | 121 | 1.2 | 0.141 | — | Comparative example |
| 9 | Y | 0.53 | 12 | 15 | 1.3 | 0.161 | 0.234 | Comparative example |
| 10 | Z | 0.24 | 23 | 31 | 1.3 | 0.145 | 0.223 | Example |
| 11 | A | 0.16 | 8 | 26 | 3.3 | 0.165 | 0.250 | Comparative example |
| 12 | A | 0.22 | 27 | 47 | 1.7 | 0.133 | 0.202 | Example |
| 13 | A | 0.15 | 25 | 102 | 4.1 | 0.128 | 0.168 | Example |
| 14 | B | 0.14 | 20 | 53 | 2.6 | 0.132 | 0.182 | Example |
| 15 | B | 0.13 | 27 | 98 | 3.7 | 0.134 | 0.172 | Example |
| 16 | B | 0.086 | 27 | 195 | 7.3 | 0.130 | 0.170 | Example |
| 17 | B | 0.072 | 33 | 204 | 6.3 | 0.128 | 0.171 | Example |
| 18 | C | 0.024 | 29 | 300 | 10.5 | 0.130 | 0.169 | Example |
| 19 | D | 0.005 | 36 | 515 | 14.5 | 0.129 | 0.165 | Example |
| 20 | D | 0.003 | 43 | 606 | 14.1 | 0.125 | 0.167 | Example |
| 21 | D | 0.008 | 97 | 976 | 10.1 | 0.123 | 0.160 | Example |
| 22 | E | <0.002 | 22 | 58 | 2.6 | 0.143 | 0.200 | Comparative example |

Example 2

Galvannealed layer was formed on each of cold-rolled steel sheets having 0.8 mm of thickness using an ordinary method, which plated steels sheet were then processed by temper-rolling. After that, a film was formed on the surface of zinc plating layer using a film-forming apparatuses given in FIG. 7 under the respective treatment conditions given in Table 3 to prepare the sample Nos. 1 to 20.

Figure 7:
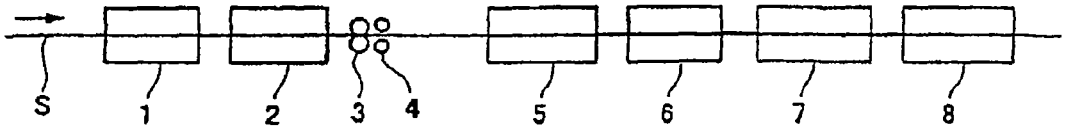
FIG. 7 shows the structure of film-forming apparatus.

First, with an acidic solution tank 2 in FIG. 7, the steel sheet was dipped into an acidic solution at 50° C. and pH 2.0 to form a liquid film on the surface of the steel sheet using squeeze rolls 3. The formed liquid film was washed in a washing tank 5 by spraying hot water at 50° C. against the steel sheet, and then the steel sheet was passed through a neutralization tank 6 without applying neutralization. The steel sheet was washed by spraying water at 50° C. thereto in a washing tank 7, followed by drying in a drier 8, thus forming the film on the surface of plating layer. The quantity of liquid film was adjusted by varying the pressure of squeeze rolls 3.

The acidic solution in an acidic solution tank 2 was an acidic solution which contained a pH buffer prepared by mixing 30 g/liter of disodium hydrogenphosphate and 20 g/liter of citric acid, adding a specific amount of iron (II) sulfate to add Fe ion thereto, and further adding sulfuric acid to adjust pH. For comparison, an acidic solution containing only iron (II) sulfate, not containing pH buffer, was used, (Sample Nos. 3 to 5).

The period of allowing to standing before water-washing is the time between the adjustment of quantity of liquid film by the squeeze rolls 3 and the start of washing in the washing tank 5. The period thereof was adjusted by varying the line speed. For some of the samples, washing was applied immediately after adjustment of the quantity of liquid film using a shower-water-washing apparatus 4 at exit of the squeeze rolls 3.

Other than the above samples, sample Nos. 15 to 17 were prepared, which samples were treated by: applying activation treatment by dipping the sample in an aqueous solution of sodium hydroxide at pH 12 in an activation tank 1 before dipping the sample in the acidic solution; and then spraying an aqueous solution of sodium hydroxide at pH 10 in a neutralization tank 6 to neutralize the acidic solution remained on the surface of the steel sheet.

For thus prepared samples, determination of the coefficient of friction, and evaluation of the bondability, the phosphatability, and the powdering resistance were given using similar methods with those applied in Example 1.

After coating the rust preventive oil, the steel sheets were allowed to standing outdoors for about 6 months while preventing external influences such as those of dust, and the generation of spot-rusts was examined. The evaluation was given as "○" rank for no generation of spot-rusts, and as "X" rank for generation of spot-rusts.

The result is given in Table 3.

Sample Nos. 9 to 14 and Nos. 18 to 20, which were Examples of the present invention, having pH buffering effect and processed by the treatment of Fe ion-containing acidic solution provided low coefficient of friction and showed excellent bondability and phosphatability.

Sample Nos. 15 to 17, which were Examples of the present invention, processed by alkali treatment in the activation tank prior to the acidic solution treatment showed lower coefficient of friction than that of the sample Nos. 12 to 14, which were treated by the same acidic solution and were allowed to standing for the same period prior to the water-washing. The sample Nos. 15 to 17 generated no spot-rusts owing to the alkali treatment in the neutralization tank after the acidic solution treatment, which samples are advantageous also for a long period of storage.

Regarding the powdering resistance, the sample Nos. 9 to 17 which were treated by acidic solutions containing 5 g/liter or smaller Fe concentration showed a tendency of decreased quantity of peeling of plating in the draw-bead test, thus these samples provided excellent powdering resistance.

On the other hand, the sample Nos. 1 and 2 of Comparative Examples which were not treated by acidic solution gave high coefficient of friction because they have no film to improve the sliding performance.

The sample Nos. 3 to 5 of Comparative Examples which were treated by acidic solution containing no pH buffer gave higher coefficient of friction than that of the samples of Examples of the present invention, though giving lower coefficient of friction than that of the sample Nos. 1 and 2, thus the sample Nos. 3 to 5 are expected to insufficiently form the film.

The sample Nos. 6 to 8 of Comparative Examples which were treated by acidic solution containing no Fe ion, though containing pH buffer, showed poor bondability or phosphatability, though providing low coefficient of friction.

Example 3

Galvannealed layer was formed on each of cold-rolled steel sheets having 0.8 mm of thickness using an ordinary method, which plated steels sheet were processed by temper-rolling. After that, a film was formed on the surface of zinc plating layer using a film-forming apparatuses having the structure given in FIG. 7 under the respective treatment conditions given in Table 4 to prepare the sample Nos. 1 to 26.

First, with the acidic solution tank 2 in FIG. 7, the steel sheet was dipped into, the acidic solution at 50° C. and pH 2.0 to form a liquid film on the surface of the steel sheet using the squeeze rolls 3. The formed liquid film was washed in the washing tank 5 by spraying hot water at 50° C. against the

TABLE 3

| Sample No. | Acidic solution: pH buffer | Acidic solution: $Fe^{2+}$ concentration | pH increase degree | Quantity of liquid film ($g/m^2$) | Time for allowing to standing (sec) | Use of activation tank | Use of neutralization tank |
|---|---|---|---|---|---|---|---|
| 1 | — | — | — | — | — | — | — |
| 2 | | | | — | — | — | — |
| 3 | — | 5 g/liter | 0.6 | 3.0 | 5.0 | — | — |
| 4 | | | | 3.0 | 10.0 | — | — |
| 5 | | | | 3.0 | 30.0 | — | — |
| 6 | Disodium | — | 7.5 | 3.0 | 5.0 | — | — |
| 7 | hydrogen- | | | 3.0 | 10.0 | — | — |
| 8 | phosphate | | | 3.0 | 30.0 | — | — |
| 9 | (30 g/liter) + | 0.5 g/liter | 7.6 | 3.0 | 5.0 | — | — |
| 10 | Citric acid | | | 3.0 | 10.0 | — | — |
| 11 | (20 g/liter) | | | 3.0 | 30.0 | — | — |
| 12 | | 5 g/liter | 8.0 | 3.0 | 5.0 | — | — |
| 13 | | | | 3.0 | 10.0 | — | — |
| 14 | | | | 3.0 | 30.0 | — | — |
| 15 | | | | 3.0 | 5.0 | ○ | ○ |
| 16 | | | | 3.0 | 10.0 | ○ | ○ |
| 17 | | | | 3.0 | 30.0 | ○ | ○ |
| 18 | | 50 g/liter | 8.3 | 3.0 | 5.0 | — | — |
| 19 | | | | 3.0 | 10.0 | — | — |
| 20 | | | | 3.0 | 30.0 | — | — |

| Sample No. | Friction factor: Condition 1 | Friction factor: Condition 2 | Powdering resistance ($g/m^2$) | Bondability | Phosphatability | Presence/absence of spot-rusts | Remark |
|---|---|---|---|---|---|---|---|
| 1 | 0.179 | 0.250 | 1.6 | ○ | ○ | ○ | Comparative example |
| 2 | 0.181 | 0.251 | 1.2 | ○ | ○ | ○ | Comparative example |
| 3 | 0.156 | 0.217 | 1.6 | ○ | ○ | X | Comparative example |
| 4 | 0.152 | 0.209 | 1.2 | ○ | ○ | X | Comparative example |
| 5 | 0.150 | 0.210 | 1.7 | ○ | ○ | X | Comparative example |
| 6 | 0.139 | 0.191 | 1.4 | X | ○ | X | Comparative example |
| 7 | 0.132 | 0.182 | 2.1 | X | ○ | X | Comparative example |
| 8 | 0.135 | 0.196 | 1.8 | X | X | X | Comparative example |
| 9 | 0.137 | 0.190 | 1.6 | ○ | ○ | X | Example |
| 10 | 0.137 | 0.187 | 1.0 | ○ | ○ | X | Example |
| 11 | 0.134 | 0.184 | 1.3 | ○ | ○ | X | Example |
| 12 | 0.131 | 0.193 | 1.8 | ○ | ○ | X | Example |
| 13 | 0.130 | 0.186 | 2.3 | ○ | ○ | X | Example |
| 14 | 0.129 | 0.179 | 0.8 | ○ | ○ | X | Example |
| 15 | 0.125 | 0.164 | 1.2 | ○ | ○ | ○ | Example |
| 16 | 0.127 | 0.165 | 1.1 | ○ | ○ | ○ | Example |
| 17 | 0.126 | 0.164 | 1.7 | ○ | ○ | ○ | Example |
| 18 | 0.135 | 0.192 | 6.5 | ○ | ○ | X | Example |
| 19 | 0.133 | 0.182 | 8.6 | ○ | ○ | X | Example |
| 20 | 0.133 | 0.191 | 7.1 | ○ | ○ | X | Example |

steel sheet, and then the steel sheet was passed through the neutralization tank 6 without applying neutralization. The steel sheet was washed by spraying water at 50° C. thereto in the washing tank 7, followed by drying in the drier 8, thus forming the film on the surface of plating layer. The quantity of liquid film was adjusted by varying the pressure of squeeze rolls 3.

The acidic solution in the acidic solution tank 2 was an acidic solution which contained a pH buffer prepared by mixing 30 g/liter of disodium hydrogenphosphate and 20 g/liter of citric acid, adding a specific amount of iron (II) sulfate to add Fe ion thereto, and further adding sulfuric acid to adjust pH. For comparison, an acidic solution containing only iron (II) sulfate, not containing pH buffer, was used, (Sample Nos. 3 to 5). To identify the influence of $Fe^{3+}$, an acidic solution containing Fe (III) sulfate was also applied to some of the samples, (sample Nos. 18 to 23).

The period of allowing to standing before water-washing is the time between the adjustment of quantity of liquid film by the squeeze rolls 3 and the start of washing in the washing tank 5. The period thereof was adjusted by varying the line speed. For some of the samples, washing was applied immediately after adjustment of the quantity of liquid film using a shower-water-washing apparatus 4 at exit of the squeeze rolls 3.

Other than the above samples, sample Nos. 15 to 17 were prepared, which samples were treated by: applying activation treatment by dipping the steel sheet in an aqueous solution of sodium hydroxide at pH 12 in the activation tank 1 before dipping the steel sheet in the acidic solution; and then spraying an aqueous solution of sodium hydroxide at pH 10 in the neutralization tank 6 to neutralize the acidic solution remained on the surface of the steel sheet.

For thus prepared samples, determination of the coefficient of friction, and evaluation of the bondability, the phosphatability, the powdering resistance, and the generation of spot-rusts were given using similar methods with those applied in Example 1.

The result is given in Table 4.

Other than the sample Nos. 18 to 23 for investigating the influence of $Fe^{3+}$, the samples gave results almost equal to those in Example 2.

The sample Nos. 18 to 23, which were treated by acidic solution varying the $Fe^{3+}$ concentration by adding iron(III) sulfate, gave low coefficient of friction and excellent bondability and phosphatability. Although the sample Nos. 18 to 20 having 2 g/liter or smaller $Fe^{3+}$ concentration showed no bruise caused by sludge, the sample Nos. 21 to 23 having larger than 2 g/liter of $Fe^{3+}$ concentration showed bruise.

TABLE 4

| Sample No. | Acidic solution: pH buffer | Acidic solution: $Fe^{2+}$ concentration | Acidic solution: $Fe^{3+}$ concentration | pH Increase degree | Quantity of liquid film ($g/m^2$) | Time for allowing to standing (sec) | Use of activation tank | Use of neutralization tank |
|---|---|---|---|---|---|---|---|---|
| 1 | — | | — | — | — | — | — | — |
| 2 | | | | | — | — | — | — |
| 3 | — | 5 g/liter | 5 g/liter | 0.6 | 3.0 | 5.0 | — | — |
| 4 | | | | | 3.0 | 10.0 | — | — |
| 5 | | | | | 3.0 | 30.0 | — | — |
| 6 | Disodium | — | — | 7.5 | 3.0 | 5.0 | — | — |
| 7 | hydrogen- | | | | 3.0 | 10.0 | — | — |
| 8 | phosphate | | | | 3.0 | 30.0 | — | — |
| 9 | (30 g/liter) + | 0.5 g/liter | — | 7.6 | 3.0 | 5.0 | — | — |
| 10 | Citric acid | | | | 3.0 | 10.0 | — | — |
| 11 | (20 g/liter) | | | | 3.0 | 30.0 | — | — |
| 12 | | 5 g/liter | — | 8.0 | 3.0 | 5.0 | — | — |
| 13 | | | | | 3.0 | 10.0 | — | — |
| 14 | | | | | 3.0 | 30.0 | — | — |
| 15 | | | | | 3.0 | 5.0 | ○ | ○ |
| 16 | | | | | 3.0 | 10.0 | ○ | ○ |
| 17 | | | | | 3.0 | 30.0 | ○ | ○ |
| 18 | | | 1 g/liter | 8.1 | 3.0 | 5.0 | — | — |
| 19 | | | | | 3.0 | 10.0 | — | — |
| 20 | | | | | 3.0 | 30.0 | — | — |
| 21 | | | 5 g/liter | 8.1 | 3.0 | 5.0 | — | — |
| 22 | | | | | 3.0 | 10.0 | — | — |
| 23 | | | | | 3.0 | 30.0 | — | — |
| 24 | | 50 g/liter | — | 8.3 | 3.0 | 5.0 | — | — |
| 25 | | | | | 3.0 | 10.0 | — | — |
| 28 | | | | | 3.0 | 30.0 | — | — |

| Sample No. | Friction factor: Condition 1 | Friction factor: Condition 2 | Powdering resistance ($g/m^2$) | Bondability | Phosphat-ability | Presence/absence of spot-rusts | Presence/absence of bruise | Remark |
|---|---|---|---|---|---|---|---|---|
| 1 | 0.179 | 0.250 | 1.7 | ○ | ○ | ○ | ○ | Comparative example |
| 2 | 0.181 | 0.251 | 1.2 | ○ | ○ | ○ | ○ | Comparative example |
| 3 | 0.156 | 0.217 | 1.1 | ○ | ○ | X | ○ | Comparative example |
| 4 | 0.152 | 0.209 | 1.1 | ○ | ○ | X | ○ | Comparative example |
| 5 | 0.150 | 0.210 | 0.9 | ○ | ○ | X | ○ | Comparative example |

TABLE 4-continued

| | | | | | | | | |
|---|---|---|---|---|---|---|---|---|
| 6 | 0.131 | 0.191 | 1.2 | X | ○ | X | ○ | Comparative example |
| 7 | 0.130 | 0.193 | 1.1 | X | ○ | X | ○ | Comparative example |
| 8 | 0.126 | 0.184 | 1.8 | X | X | X | ○ | Comparative example |
| 9 | 0.134 | 0.195 | 1.6 | ○ | ○ | X | ○ | Example |
| 10 | 0.130 | 0.191 | 1.3 | ○ | ○ | X | ○ | Example |
| 11 | 0.135 | 0.195 | 1.3 | ○ | ○ | X | ○ | Example |
| 12 | 0.131 | 0.179 | 1.2 | ○ | ○ | X | ○ | Example |
| 13 | 0.138 | 0.192 | 1.2 | ○ | ○ | X | ○ | Example |
| 14 | 0.140 | 0.186 | 1.0 | ○ | ○ | X | ○ | Example |
| 15 | 0.138 | 0.171 | 1.0 | ○ | ○ | ○ | ○ | Example |
| 16 | 0.133 | 0.165 | 1.8 | ○ | ○ | ○ | ○ | Example |
| 17 | 0.130 | 0.164 | 1.3 | ○ | ○ | ○ | ○ | Example |
| 18 | 0.140 | 0.198 | 2.5 | ○ | ○ | X | ○ | Example |
| 19 | 0.138 | 0.199 | 2.3 | ○ | ○ | X | ○ | Example |
| 20 | 0.133 | 0.195 | 2.6 | ○ | ○ | X | ○ | Example |
| 21 | 0.138 | 0.187 | 3.5 | ○ | ○ | X | X | Example |
| 22 | 0.133 | 0.182 | 3.9 | ○ | ○ | X | X | Example |
| 23 | 0.130 | 0.185 | 3.3 | ○ | ○ | X | X | Example |
| 24 | 0.139 | 0.191 | 8.2 | ○ | ○ | X | ○ | Example |
| 25 | 0.135 | 0.190 | 7.2 | ○ | ○ | X | ○ | Example |
| 28 | 0.131 | 0.193 | 8.5 | ○ | ○ | X | ○ | Example |

The invention claimed is:

1. A method for manufacturing hot dip galvanized steel sheet comprising the steps of: hot-dip-galvanizing a steel sheet; temper-rolling the hot dip galvanized steel sheet to form a flat part on a surface of the galvanized plating layer; contacting the temper-rolled hot dip galvanized steel sheet with an acidic solution containing Fe ion composed of $Fe^{3+}$ and $Fe^{2+}$ and having a pH buffering effect to form a film being composed of a compound containing Zn, Fe, and O on a surface of the plating layer; after determining that the $Fe^{3+}$ concentration has reached 2 g/liter, controlling the concentration of the $Fe^{3+}$ in the acidic solution to be not more than 2 g/liter by renewing the acidic solution or dissolving Fe in the acidic solution when the $Fe^{3+}$ concentration exceeds 2 g/liter; and standing the hot dip galvanized steel sheet for 1 to 30 seconds after contacting with the acidic solution, followed by washing thereof with water, wherein the acidic solution contains at least one of sulfuric acid salt of Fe, nitric acid salt of Fe, and chloride of Fe, and having an Fe ion concentration in a range from 0.1 to 10 g/liter.

2. The method of manufacturing hot dip galvanized steel sheet as in claim 1, wherein the hot dip galvanized steel sheet contacts with the acidic solution so as the quantity of acidic solution retained on the surface of the hot dip galvanized steel sheet to become not more than 3 $g/m^2$.

3. The method of manufacturing hot dip galvanized steel sheet as in claim 1, wherein the acidic solution gives a degree of pH increase in a range from 3 to 20, which degree of pH increase is defined by the quantity of 1 mole/liter sodium hydroxide solution (ml) necessary to increase the pH of 1 liter of the acidic solution from 2 to 5.

4. The method of manufacturing hot dip galvanized steel sheet as in claim 1, wherein the acidic solution contains 5 to 50 g/liter of at least one of acetic acid salt, phthalic acid salt, citric acid salt, succinic acid salt, lactic acid salt, tartaric acid salt, boric acid salt, and phosphoric acid salt, and giving pH in a range from 1 to 5.

5. The method of manufacturing hot dip galvanized steel sheet as in claim 1 further comprising the step of contacting the hot dip galvanized steel sheet with an alkaline solution, prior to the step of contacting the hot dip galvanized steel sheet with the acidic solution, to activate the surface thereof.

6. The method of manufacturing hot dip galvanized steel sheet as in claim 1 further comprising the step of contacting the hot dip galvanized steel sheet with an alkaline solution, after the step of contacting the hot dip galvanized steel sheet with the acidic solution, to neutralize the acidic solution remained on the surface thereof.

7. The method of manufacturing hot dip galvanized steel sheet as in claim 1 further comprising the step of heating the hot dip galvanized steel sheet to apply alloying treatment to the plating layer.

8. A method of manufacturing hot dip galvanized steel sheet as in claim 1, wherein the acidic solution has an Fe ion concentration in a range from 0.1 to 5 g/liter.

9. A method for manufacturing hot dip galvanized steel sheet comprising the steps of: hot-dip-galvanizing a steel sheet; temper-rolling the hot dip galvanized steel sheet to form a flat part on a surface of the galvanized plating layer; contacting the temper-rolled hot dip galvanized steel sheet with an acidic solution containing Fe ion composed of $Fe^{3+}$ and $Fe^{2+}$ and having a pH buffering effect to form a film being composed of a compound containing Zn, Fe, and O on a surface of the plating layer, wherein the acidic solution contains at least one of sulfuric acid salt of Fe, nitric acid salt of Fe, and chloride of Fe, and having an Fe ion concentration in a range from 0.1 to 10 g/liter; after determining that the $Fe^{3+}$ concentration has reached 2 g/liter, controlling the concentration of the $Fe^{3+}$ in the acidic solution to be not more than 2 g/liter by renewing the acidic solution or dissolving Fe in the acidic solution when the $Fe^{3+}$ concentration exceeds 2 g/liter; standing the hot dip galvanized steel sheet for 1 to 30 seconds after contacting with the acidic solution, followed by washing thereof with water; and contacting the hot dip galvanized steel sheet with an alkaline solution to neutralize the acidic solution remained on the surface thereof.

10. The method of manufacturing hot dip galvanized steel sheet as in claim 9, wherein the hot dip galvanized steel sheet contacts with the acidic solution so as the quantity of acidic solution retained on the surface of the hot dip galvanized steel sheet to become not more than 3 $g/m^2$.

11. The method of manufacturing hot dip galvanized steel sheet as in claim 9, wherein the acidic solution gives a degree of pH increase in a range from 3 to 20, which degree of pH increase is defined by the quantity of 1 mole/liter sodium hydroxide solution (ml) necessary to increase the pH of 1 liter of the acidic solution from 2 to 5.

12. The method of manufacturing hot dip galvanized steel sheet as in claim 9, wherein the acidic solution contains 5 to 50 g/liter of at least one of acetic acid salt, phthalic acid salt, citric acid salt, succinic acid salt, lactic acid salt, tartaric acid salt, boric acid salt, and phosphoric acid salt, and giving pH in a range from 1 to 5.

13. The method of manufacturing hot dip galvanized steel sheet as in claim 9 further comprising the step of contacting the hot dip galvanized steel sheet with an alkaline solution, prior to the step of contacting the hot dip galvanized steel sheet with the acidic solution, to activate the surface thereof.

14. The method of manufacturing hot dip galvanized steel sheet as in claim 9 further comprising the step of heating the hot dip galvanized steel sheet to apply alloying treatment to the plating layer.

* * * * *